US006949501B2

(12) United States Patent
Himmrich et al.

(10) Patent No.: US 6,949,501 B2
(45) Date of Patent: Sep. 27, 2005

(54) AQUEOUS LIQUID DETERGENT DISPERSIONS CONSISTING OF A SEC-ALKANE SULFONATE AND AN ALKYL HYDROXYETHYL AMMONIUM SALT

(75) Inventors: Johannes Himmrich, Eppstein (DE); Ulrike Reploeg, Frankfurt (DE); Werner Skrypzak, Hofheim (DE); Dennis Miller, Kelkheim (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 10/765,317

(22) Filed: Jan. 26, 2004

(65) Prior Publication Data

US 2004/0204336 A1 Oct. 14, 2004

(30) Foreign Application Priority Data

Jan. 28, 2003 (DE) ..... 103 03 130

(51) Int. Cl.[7] ..... C11D 1/65

(52) U.S. Cl. ..... 510/496; 510/123; 510/125; 510/127; 510/330; 510/423; 510/424; 510/426; 510/484; 510/495; 510/504; 510/536

(58) Field of Search ..... 510/123, 125, 510/127, 330, 423, 424, 426, 484, 495, 496, 504, 536

(56) References Cited

U.S. PATENT DOCUMENTS

| | | | | |
|---|---|---|---|---|
| 3,586,715 A | | 6/1971 | Smeets | |
| 4,515,704 A | | 5/1985 | Akred et al. | |
| 6,017,874 A | * | 1/2000 | Lappas et al. | 510/504 |
| 6,087,314 A | | 7/2000 | Heinzman et al. | |
| 6,093,218 A | | 7/2000 | Hall et al. | |
| 6,103,685 A | | 8/2000 | Hall | |
| 6,242,405 B1 | * | 6/2001 | Lykke et al. | 510/321 |
| 6,955,752 | | 3/2002 | Loeffer et al. | |
| 6,437,068 B2 | | 8/2002 | Loffler | |
| 6,506,833 B2 | | 1/2003 | Brungs et al. | |
| 6,683,144 B2 | | 1/2004 | Loeffler et al. | |
| 2002/0155974 A1 | | 10/2002 | Metcalfe et al. | |

FOREIGN PATENT DOCUMENTS

| | | | |
|---|---|---|---|
| EP | 0 405 967 | | 1/1991 |
| EP | 405967 | * | 1/1991 |
| EP | 1 162 254 | | 12/2001 |

* cited by examiner

*Primary Examiner*—Charles Boyer
(74) *Attorney, Agent, or Firm*—Richard P. Silverman

(57) ABSTRACT

Aqueous liquid detergent dispersions are claimed which essentially comprise

5% by weight to 35% by weight of anionic surfactant

10% by weight to 50% by weight of builders,

0% by weight to 10% by weight of electrolytes and 0.1% by weight to 10% by weight of quaternary alkylhydroxyethylammonium salt, where the % by weight ratio of anionic surfactant to quaternary alkylhydroxyethylammonium salt is 50:1 to 2:1.

10 Claims, No Drawings

AQUEOUS LIQUID DETERGENT DISPERSIONS CONSISTING OF A SEC-ALKANE SULFONATE AND AN ALKYL HYDROXYETHYL AMMONIUM SALT

Liquid detergents in disperse form based on water, comprising surfactants, quaternary alkyldimethylhydroxyethylammonium salt and/or alkylmethylbishydroxyethylammonium salt, one or more electrolytes and one or more builders.

By adding hydroxyethyl quats to an aqueous solution of surfactants, electrolytes and builders, a very stable dispersion with good detergency and favorable viscosity behavior is obtained.

Compared with solid, pulverulent or particulate products, liquid detergents have a number of applications-related advantages. They can be measured out easily, dissolve rapidly in the wash water and can be applied in concentrated solutions or dispersions to soiled areas of the textiles to be washed. Moreover, it is possible to incorporate substances which would decompose during drying operations and are unsuitable for solid compositions into liquid detergent formulations.

As a result of limited solubility, only restricted amounts of soluble ingredients, e.g. builders and surfactants, can be incorporated into clear liquid detergent formulations and, accordingly, higher doses have to be used in the washing operation in order to ensure good detergency even at high water hardnesses and with corresponding partial deactivation of the anionic surfactants.

In liquid detergent dispersions it is possible to use very much larger amounts of ingredients and thus a reduction in dosing per wash operation can be achieved. In addition, liquid detergent dispersions permit the use of only sparingly water-soluble ingredients. Furthermore, liquid detergent dispersions generally have significantly higher viscosities than clear liquid detergent formulations.

On the other hand, liquid detergent dispersions have a tendency toward phase separation during prolonged storage periods and in the case of relatively large temperature fluctuations.

For example, some products experience separation upon storage, others upon cooling and cannot be readily dispersed again. In some cases, the viscosity of the product changes; it either becomes too thick and is no longer flowable or appears too watery thin.

The object was to prepare liquid-disperse detergent formulations which, as well as having a good detergency, do not exhibit phase separation over long periods of time and also in cases of large temperature fluctuations, have favorable rheological behavior and can be prepared cost effectively.

EP 170 091 claims disperse liquid detergents based on water, comprising linear alkylbenzenesulfonate, potassium or sodium tripolyphosphate and a solid builder. The formulations are notable for the fact that, in the presence of the electrolyte, the solubility of the surfactant in water is reduced and, as a consequence of the salting-out effect, this is present in the aqueous phase in dispersed form.

Our own investigations show that surfactants with better water solubility when compared with alkylbenzenesulfonate, for example sec-alkanesulfonates, exhibit a low salting-out effect in the presence of electrolytes and consequently cannot be formulated as dispersions in the same way.

Surprisingly, it has been found that the addition of small amounts of a quaternary alkylhydroxyethylammonium compound to an aqueous mixture comprising anionic surfactants, builders and optionally electrolytes can improve the phase stability and solubility of liquid detergent dispersions.

As well as the improved storage stability, a better detergency of the liquid detergent dispersions according to the invention was found for particular soilings, in particular toward oil- or grease-containing stains.

The invention provides aqueous liquid detergent dispersions which essentially comprise 5 to 35% by weight, preferably 5 to 25% by weight, in particular 5 to 20% by weight, of anionic surfactant 10 to 50% by weight, preferably 10 to 40% by weight, in particular 10 to 30% by weight, of builders, 0 to 10% by weight, preferably 0 to 7% by weight, in particular 0 to 4% by weight, of electrolytes and 0.1 to 10% by weight of quaternary alkylhydroxyethylammonium salt, where the % by weight ratio of anionic surfactant to quaternary alkylhydroxyethylammonium salt is 50:1 to 2:1, preferably 30:1 to 2:1, in particular 15:1 to 2:1.

The compositions according to the invention preferably comprise quaternary alkylhydroxyethylammonium salt according to the formula 1

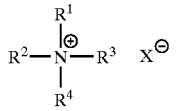

(1)

where $R^1$ is a linear or branched, saturated or unsaturated alkyl group having 5 to 22 carbon atoms, preferably 8 to 18 carbon atoms, particularly preferably 12 to 14 carbon atoms, $R^2$ is a methyl group, $R^3$ is a methyl group or a group of the formula $-A-(OA)_n-OH$, where A may be a $—C_2H_4—$ and/or $—C_3H_6—$ group and n may be a number from 0 to 20, $R^4$ is a group of the formula $-A-(OA)_n-OH$ and X is an anion, X is, for example, chloride, bromide, iodide, fluoride, sulfate, hydrogensulfate, carbonate, hydrogencarbonate, acetate, citrate, phosphate, mono- and di-hydrogenphosphate, pyrophosphate, polyphosphate, metaphosphate, nitrate, methylsulfate, phosphonate, methylphosphonate, methanedisulfonate, methylsulfonate, ethanesulfonate or an anion of the formulae $R^6SO_3$, $R^7SO_4$ or $R^6COO$, in which $R^6$ and $R^7$ are $C_2$–$C_{20}$-alkyl, preferably $C_{10}$–$C_{18}$-alkyl, and $R^7$ is additionally also $C_1$–$C_{18}$-alkylphenyl.

As compound of the formula (1), particular preference is given to quaternary $C_{12}$–$C_{14}$-alkyldimethylhy- droxyethylammonium chloride or methosulfate;

Suitable anionic surfactants are, in particular, sec-alkanesulfonates, but also alkyl ester sulfonates, alkyl sulfates, carboxylates, phosphates, sulfonates, arylalkylsulfonates, alkyl ether sulfates and mixtures of said compounds. Some of the suitable types of anionic surfactants will be described in more detail below.

Secondary Alkanesulfonates

Secondary alkanesulfonates are surfactants of the formula $R—SO_3M$, whose alkyl group R is saturated or unsaturated, linear or branched and which can also bear hydroxyl groups, where the terminal carbon atoms of the alkyl chain do not have a sulfonate group.

Preference is given to secondary alkanesulfonates with linear alkyl groups having 9 to 25 carbon atoms, preferably having 10 to 20 carbon atoms, particularly preferably having 13 to 17 carbon atoms. Counterion M may be sodium, potassium, ammonium, mono-, di- or trialkanolammonium, calcium, magnesium ion or mixtures thereof. Preference is given to sodium salts of secondary alkanesulfonates.

Alkyl Ester Sulfonates

Alkyl ester sulfonates are linear esters of $C_8$–$C_{20}$-carboxylic acids (i.e. fatty acids) which are sulfonated by $SO_3$. Suitable starting materials are natural fatty derivatives, such as, for example, tallow or palm oil fatty acid.

Alkyl Sulfates

Alkyl sulfates are water-soluble salts or acids of the formula $ROSO_3M$, in which R is preferably a $C_{10}$–$C_{24}$-hydrocarbon radical, preferably an alkyl or hydroxyalkyl radical having 10 to 20 carbon atoms, particularly preferably a $C_{12}$–$C_{18}$-alkyl or hydroxyalkyl radical. M is hydrogen or a cation, e.g. an alkali metal cation (e.g. sodium, potassium, lithium) or ammonium or substituted ammonium, e.g. a methyl, dimethyl and trimethylammonium cation or a quaternary ammonium cation, such as tetramethylammonium and dimethylpiperidinium cation and quaternary ammonium cations derived from alkylamines, such as ethylamine, diethylamine, triethylamine and mixtures thereof. Alkyl chains with $C_{12}$–$C_{16}$ are preferred for low washing temperatures (e.g. below about 50° C.) and alkyl chains with $C_{16}$–$C_{18}$ are preferred for higher washing temperatures (e.g. above about 50° C.).

Alkyl Ether Sulfates

The alkyl ether sulfates are water-soluble salts or acids of the formula $RO(A)_mSO_3M$, in which R is an unsubstituted $C_{10}$–$C_{24}$-alkyl or hydroxyalkyl radical having 10 to 24 carbon atoms, preferably a $C_{12}$–$C_{20}$-alkyl or hydroxyalkyl radical, particularly preferably a $C_{12}$–$C_{18}$-alkyl or hydroxyalkyl radical. A is an ethoxy or propoxy unit, m is a number greater than 0, typically between about 0.5 and about 6, particularly preferably between about 0.5 and about 3 and M is a hydrogen atom or a cation, such as, for example, a metal cation (e.g. sodium, potassium, lithium, calcium, magnesium, etc.), ammonium or a substituted ammonium cation. Examples of substituted ammonium cations are methyl, dimethyl, trimethylammonium and quaternary ammonium cations, such as tetramethylammonium and dimethylpiperidinium cations, and those which are derived from alkylamines, such as ethylamine, diethylamine, triethylamine, mixtures thereof and the like. Examples which may be mentioned are $C_{12}$–$C_{18}$-alkyl polyethoxylate (1.0) sulfate, $C_{12}$–$C_{18}$-alkyl polyethoxylate(2.25) sulfate, $C_{12}$–$C_{18}$-alkyl polyethoxylate(3.0) sulfate, $C_{12}$–$C_{18}$-alkyl polyethoxylate(4.0) sulfate, where the cation is sodium or potassium.

Other anionic surfactants which are useful for use in washing and cleaning compositions are $C_8$–$C_{24}$-olefinsulfonates, sulfonated polycarboxylic acids prepared by sulfonation of the pyrrolysis products of alkaline earth metal citrates, as described, for example, in British patent GB 1,082,179, alkylglycerol sulfates, fatty acylglycerol sulfates, oleylglycerol sulfates, alkylphenol ether sulfates, primary paraffin sulfonates, alkyl phosphates, alkyl ether phosphates, isethionates, such as acylisethionates, N-acyltaurides, alkyl succinamates, sulfosuccinates, monoesters of sulfosuccinates (particularly saturated and unsaturated $C_{12}$–$C_{18}$-monoesters) and diesters of sulfosuccinates (particularly saturated and unsaturated $C_{12}$–$C_{18}$-diesters), acyl sarcosinates, sulfates of alkylpolysaccharides, such as sulfates of alkylglycosides, branched primary alkyl sulfates and alkyl polyethoxycarboxylates such as those of the formula $RO(CH_2CH_2)_kCH_2COO^-M^+$ in which R is a $C_8$–$C_{22}$-alkyl, k is a number from 0 to 10 and M is a cation which forms a soluble salt. Resin acids or hydrogenated resin acids, such as rosin or hydrogenated rosin or tall oil resins and tall oil resin acids can likewise be used.

The disperse liquid detergents according to the invention comprise one or more builders as further component.

Suitable organic and inorganic builders are neutral or, in particular, alkaline salts which can precipitate out calcium ions or form complexes with them. Builders such as orthophosphates and condensed phosphates, e.g. pyrophosphates, triphosphates, tetraphosphates, polyphosphates and metaphosphates, and also finely crystalline, synthetic hydrous zeolites are preferred. The alkali metal phosphates which can be present in the form of their alkaline, neutral or acidic sodium or potassium salts are particularly suitable. Examples thereof are trisodium phosphate, tetrasodium diphosphate, disodium dihydrogenphosphate, pentasodium triphosphate, so-called sodium hexametaphosphate, oligomeric trisodium phosphate with degrees of oligomerization of from 5 to 1000, in particular 5 to 50, and mixtures of sodium and potassium salts. As well as phosphates and zeolites, preference is also given to using phyllosilicates and amorphous silicates, and also carbonates and hydrogen carbonates.

Organic builders which can be used are, for example, citric acid, nitriloacetate (NTA), and ethylenediaminetetraacetic acid, which are preferably used in the form of their salts, and phosphonic and polyphosphonic acids. Analogously to this, it is also possible to use polymeric carboxylates and salts thereof. These include, for example, the salts of homopolymeric or copolymeric polyacrylates, polymethacrylates and, in particular, copolymers of acrylic acid with maleic acid, preferably those of 50% to 10% maleic acid, and polyaspartic acid and also polyvinylpyrrolidone and urethanes. The relative molecular mass of the homopolymers is generally between 1000 and 100 000, that of the copolymers is between 2000 and 200 000, preferably 50 000 to 120 000, based on the free acid, particularly suitable are also water-soluble polyacrylates which have been crosslinked, for example, with about 1% of a polyallylether of sucrose and which have a relative molecular mass above one million. Examples thereof are the polymers obtainable under the name Carbopol 940 and 941. Suitable phosphonates are, for example, acetodiphosphonates, aminotrismethylenephosphonates and ethylenetetramethylenephosphonates.

"Electrolytes" are understood as meaning non-interfacial-active, water-soluble, ionic compounds which reduce the solubility or the micelle concentration of surfactants in the aqueous formulation and bring about a "salting-out effect". Alkali metal or ammonium chlorides, nitrates, phosphates, carbonates, sulfates, silicates, acetates, citrates or polyphosphates are suitable. Preference is given to using potassium chloride, potassium sulfate, potassium carbonate, pentasodium triphosphate and pentapotassium triphosphate.

In addition to the anionic surfactants, the disperse liquid detergents according to the invention can also comprise nonionic, amphoteric, but also cationic surfactants.

Preferred nonionic surfactants are fatty alcohol oxyethylates having about 1 to about 25 mol of ethylene oxide. The alkyl chain of the aliphatic alcohols may be linear or branched, primary or secondary, and generally contains 8 to 22 carbon atoms. Particular preference is given to the condensation products of alcohols which contain an alkyl chain from 10 to 20 carbon atoms with 2 to 18 mol of ethylene oxide per mole of alcohol. The alkyl chain may be saturated or else unsaturated. The alcohol ethoxylates may equally have a narrow homolog distribution of the ethylene oxide (narrow range ethoxylates) or a broad homolog distribution of the ethylene oxide (broad range ethoxylates). Examples of commercially available nonionic surfactants of this type are Tergitol™ 15-S-9 (condensation product of a $C_{11}$–$C_{15}$-linear secondary alcohol with 9 mol of ethylene oxide), Tergitol™ 24-L-NMW (condensation product of a $C_{12}$–$C_{14}$-linear primary alcohol having 6 mol of ethylene oxide with a narrow molecular weight distribution). This product class likewise include the Genapol™ grades from Clariant GmbH.

Moreover, other known types of nonionic surfactants are also suitable according to the invention, such as polyethylene, polypropylene and polybutylene oxide adducts of fatty alcohols having 8 to 22 carbon atoms in the alkyl chain, and of alkylphenols having 6 to 12 carbon atoms in the alkyl chain, addition products of ethylene oxide with a hydrophobic base formed from the condensation of propylene oxide with propylene glycol or addition products of ethylene oxide with a reaction product of propylene oxide and ethylenediamine, but also fatty acid polyhydroxamides and fatty acid amidoalkoxylates.

In addition, it is possible to use semipolar nonionic surfactants, for example amine oxides of the formula

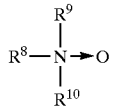

in which $R^8$ is an alkyl, hydroxyalkyl or alkylphenol group or mixtures thereof with a chain length of from 8 to 22 carbon atoms; $R^9$ is an alkylene or hydroxyalkylene group having 2 to 3 carbon atoms or a mixtures thereof; $R^{10}$ is an alkyl or hydroxyalkyl group having 1 to 3 carbon atoms or a polyethylene oxide group having 1 to 3 ethylene oxide units. The $R^{10}/R^9$ groups can be joined together via an oxygen or nitrogen atom and thus form a ring.

These amine oxides include, in particular, $C_{10}$–$C_{18}$-alkyldimethylamine oxides and $C_8$–$C_{12}$-alkoxyethyldihydroxyethylamine oxides.

Examples of amphoteric surfactants which can be used in the formulations of the present invention are primarily those which are described as derivatives of aliphatic secondary and tertiary amines in which the aliphatic radical may be linear or branched and in which one of the aliphatic substituents contains between 8 and 18 carbon atoms and contains an anionic, water-soluble group, such as, for example, carboxy, sulfonate, sulfate, phosphate or phosphonate. Amphoteric surfactants in this connection include amphoteric imidazolinium surfactants, as shown in the formula below:

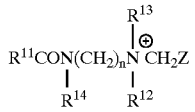

in which $R^{11}$ is $C_8$–$C_{22}$-alkyl or alkenyl, preferably $C_{12}$–$C_{16}$, $R^{12}$ is hydrogen or a group of the formula $CH_2CO_2M$, $R^{13}$ is a group of the formulae $CH_2CH_2OH$ or $CH_2CH_2OCH_2CHCOOM$, $R^{14}$ is hydrogen or a group of the formulae $CH_2CH_2OH$ or $CH_2CH_2OCH_2CHCOOM$, Z is $CO_2M$ or $CH_2CO_2M$, n is 2 or 3, preferably 2, M is hydrogen or a cation, such as alkali metal, alkaline earth metal, ammonia or alkanolammonium.

Preferred amphoteric surfactants of the above formula are monocarboxylates and dicarboxylates. Examples of these compounds include cocoamphocarboxypropionate, cocoamidocarboxypropionic acid, cocoamphocarboxyglycinate (or also referred to as cocoamphodiacetate) and cocoamphoacetate.

Further preferred amphoteric surfactants are alkyldimethylbetaines, alkylamidobetaines and alkyldipolyethoxybetaines with an alkyl radical, which may be linear or branched, having 8 to 22 carbon atoms, preferably having 8 to 18 carbon atoms and particularly preferably having 12 to 18 carbon atoms. These compounds are marketed, for example, by Clariant GmbH under the trade name Genagen®.

Typical examples of cationic surfactants are quaternary ammonium compounds and ester quats, in particular quaternized fatty acid alkanolamine ester salts and dialkylaminopropylamine ester salts.

Auxiliaries and Additives

The liquid detergents according to the invention can comprise the auxiliaries and additives customary for these products, for example bleach activators, bleach catalysts, optical brighteners, graying inhibitors, color transfer inhibitors, solubility promoters, hydrotropes, enzymes, enzyme stabilizers, thickeners, preservatives, fragrances and dyes, pearlizing agents, foam inhibitors, sequesterants, corrosion inhibitors and antioxidants.

Representative examples of bleach activators are N,N,N',N'-tetraacetylethylenediamine (TAED), nonanoylcaprolactam phenylsulfonate ester (APES), glucose pentaacetate (GPA), xylose tetraacetate (TAX), acyloxybenzenesulfonates (e.g. nonanoyloxybenzenesulfonate (NOBS), sodium 4-benzoyloxybenzenesulfonate (SBOBS), sodium trimethylhexanoyloxybenzenesulfonate (STHOBS), diacetyldioxohexahydrotriazine (DADHT), tetraacetylglucoluril (TAGU), tetraacetylcyanic acid (TACA), di-N-acetyldimethylglyoxine (ADMG) and 1-phenyl-3-acetylhydantoin (PAH) and nitrilotriacetate (NTA), and ammonium nitriles ("nitrile quats"), which are used in combination with a source of hydrogen peroxide. Examples thereof are perborate monohydrate, perborate tetrahydrate, percarbonates, alkali metal persulfates, persilicates and percitrates, where sodium is the preferred alkali metal, and hydrogen peroxide adducts onto urea or amine oxides. Additionally or alternatively, peroxycarboxylic acids, for example dodecanedipercarboxylic acid or phthalimidopercarboxylic acids, which may optionally be substituted on the aromatic, may be present. The addition of small amounts of known bleach stabilizers, such as, for example, of phosphonates, borates, or metaborates and metasilicates, and magnesium salts, such as magnesium sulfate, may be advantageous.

As optical brighteners, the compositions may comprise derivatives of diaminostilbenedisulfonic acid and alkali metal salts thereof. Suitable compounds are, for example, salts of 4,4'-bis(2-anilino-4-morpholino-1,3,5-triazinyl-6-amino)stilbene-2,2'-disulfonic acid or compounds with a similar structure which bear a diethanolamino group, a methylamino group, an anilino group or a 2-methoxyethylamino group instead of the morpholino group. Likewise suitable are substituted diphenylstyryls, e.g. alkali metal salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl.

The maximum content of brighteners in the compositions according to the invention is 0.5% by weight, preference being given to using amounts of from 0.02 to 0.25% by weight.

Antigraying inhibitors have the task of keeping the released soil suspended in the liquor. Suitable for this purpose are water-soluble colloids of a mostly organic nature, for example starch and cellulose, and derivatives thereof, glue, gelatin, salts of ether carboxylic acids or ether sulfonic acids of starch or of cellulose or salts of acidic sulfuric esters of cellulose or of starch. Water-soluble polyamides which contain acidic groups are also suitable for this purpose. In addition, it is also possible to use starch derivatives other than the abovementioned ones, e.g. aldehyde starches.

Preference is given to using cellulose ethers, such as carboxymethylcellulose (Na salt), methylcellulose, hydroxyalkylcellulose and mixed ethers, such as methylhydroxyethylcellulose, methyl hydroxypropylcellulose, methylcarboxymethylcellulose in amounts of from 0.3% by weight to 5% by weight, based on the finished composition.

Suitable color transfer inhibitors are polyvinylpyrrolidones, polyvinylimidazoles, polymeric N-oxides, such as poly(vinylpyridine N-oxide) and copolymers of vinylpyrrolidone with vinylimidazole. Color protection additives, such as, for example, quaternary polyamine derivatives, cationic methylolamides or formaldehyde condensation products, can also be used.

As foam inhibitors, the compositions according to the invention can comprise fatty acid alkyl ester alkoxylates, organopolysiloxanes and mixtures thereof with microfine, optionally silanized silica, and paraffins, waxes, microcrystalline waxes and mixtures thereof with silanized silica. Mixtures of different foam inhibitors, e.g. those of silicone oil, paraffin oil or waxes, can also be used advantageously.

The desired viscosity of the compositions can be adjusted by adding water and/or organic solvents or by adding a combination of organic solvents and thickeners.

In principle, suitable organic solvents are all mono- or polyhydric alcohols. Preference is given to using alcohols having 1 to 4 carbon atoms, such as methanol, ethanol, propanol, isopropanol, straight-chain and branched butanol, glycerol and mixtures of said alcohols. Further preferred alcohols are polyethylene glycols with a relative molecular mass below 2000. In particular, a use of polyethylene glycol with a relative molecular mass between 200 and 600 and in amounts up to 45% by weight and of polyethylene glycol with a relative molecular mass between 400 and 600 in amounts of from 5 to 25% by weight is preferred. An advantageous mixture of solvents consists of monomeric alcohol, for example ethanol and polyethylene glycol in the ratio 0.5:1 to 1.2:1, where the liquid detergents according to the invention may comprise 8 to 12% by weight of such a mixture.

Further suitable solvents are, for example, triacetin (glycerol triacetate) and 1-methoxy-2-propanol.

As thickeners, preference is given to using hydrogenated castor oil, salts of long-chain fatty acids, preferably in amounts of from 0 to 5% by weight and in particular in amounts of from 0.5 to 2% by weight, for example sodium, potassium, aluminum, magnesium and titanium stearates or the sodium and/or potassium salts of behenic acid, and also polysaccharides, in particular xanthan gum, guar guar, agar agar, alginates and Tyloses, carboxymethylcellulose and hydroxyethylcellulose, and also relatively high molecular weight polyethylene glycol mono- and diesters of fatty acids, polyacrylates, polyvinyl alcohol and polyvinylpyrrolidone.

Likewise suitable are copolymers based on acryloyldimethyltauric acid, as described in EP 10 60 142, EP 10 28 129, EP 11 16 733 and Hostacerin® AMPS.

Suitable hydrotropes are, for example, sodium toluenesulfonate, sodium cumenesulfonate, sodium xylenesulfonate, alkanephosphonic acids and alkenyldicarboxylic acids, and anhydrides thereof.

Suitable enzymes are those from the class of proteases, lipases, amylases and cellulases or mixtures thereof. Their proportion may be 0.2 to 3% by weight. The enzymes can be adsorbed to carrier substances and/or be embedded in coating substances.

In order to bind traces of heavy metals, the salts of polyphosphoric acids, such as 1-hydroxyethane-1,1-diphosphonic acid (HEDP), ethylenediaminetetramethylenephosphonic acid (EDTMP) and diethylenetriaminepentamethylenephosphonic acid (DTPMP) may be used.

Suitable preservatives are, for example, phenoxyethanol, formaldehyde solution, parabens, isothiazolinones, pentanediol or sorbic acid.

Suitable pearlizing agents are, for example, glycol distearic esters, such as ethylene glycol distearate, but also fatty acid monoglycol esters.

The liquid detergents according to the invention can be prepared by simply mixing the ingredients, which can be added without a diluent or in the form of a solution to an automatic mixer.

The examples below are intended to illustrate the invention in more detail without limiting it thereto. All percentages are percentages by weight.

EXAMPLES

1. Formulations I (*comparative examples)

| | Content [%] | | | | | |
|---|---|---|---|---|---|---|
| Ingredients | 1* | 2* | 3 | 4 | 5 | 6 |
| LAS | 9 | — | — | — | — | — |
| Alkyl sulfate | 1 | 1 | 1 | 1 | — | — |
| TEA | 0.5 | 0.5 | 0.5 | 0.5 | — | — |
| Hostapur SAS | — | 9 | 9 | 9 | 9 | 9 |
| Genapol DU 030 | 2 | 2 | 2 | 2 | 2 | 2 |
| STPP | 14 | 14 | 14 | — | 14 | 14 |
| PTPP | — | — | — | 14 | — | — |
| Sodium disilicate | 0.5 | 0.5 | 0.5 | 0.5 | 0.5 | 0.5 |
| Praepagen HY | — | — | 2.0 | 1.0 | 0.8 | 1.4 |
| KCl | — | — | — | — | 2, 3 | — |
| $K_2SO_4$ | — | — | — | — | — | 2.0 |
| Opt. brightener | 0.1 | 0.1 | 0.1 | 0.1 | 0.1 | 0.1 |
| Enzyme (cellulase) | 0.25 | 0.25 | 0.25 | 0.25 | 0.25 | 0.25 |
| Viscosity [mPa□s ] | 2750 | — | 2200 | 950 | 1650 | 1650 |
| (Brookfield RVT, 20 rpm, 22° C.) | (spdl 3) | — | (spdl 3) | (spdl 3) | (spdl 3) | (spdl 3) |

2. Storage test with formulations I

| Conditions | 1* | 2* | 3 | 4 | 5 | 6 |
|---|---|---|---|---|---|---|
| RT, 28 days | ok | two phases | ok | ok | ok | ok |
| 40° C., 28 days | two phases | two phases | ok | ok | ok | ok |
| 5° C., 28 days | ok | two phases | ok | ok | ok | ok |

ok = homogeneous dispersion, no phase separation observable

3. Washing experiments with formulations I

| Conditions: | LINITEST | | |
|---|---|---|---|
| Temperature: 40° C.<br>German hardness<br>Dosing: 10 g/l | Washing time: 30 min | | Water hardness: 12° |

| | Reflectance (457 nm, UV filter) [%] | | | | |
|---|---|---|---|---|---|
| Test fabric | 1* | 3 | 4 | 5 | 6 |
| Red wine | 51 | 51 | 50 | 51 | 51 |
| Coffee | 57 | 58 | 58 | 59 | 59 |
| Tea | 43 | 43 | 43 | — | — |
| Chlorophyll/plant oil | 43 | 42 | 42 | 41 | 41 |
| Pigment/oil | 48 | 49 | 48 | n.d. | n.d. |
| Skin sebum | 57 | 58 | 58 | 58 | 60 |
| Blood/milk/ink | 34 | 34 | 33 | 31 | 32 |
| Cocoa | 38 | 39 | 39 | — | — |

4. Formulations II (*comparative examples)

| | Content [%] | | | |
|---|---|---|---|---|
| Ingredients | 1* | 7* | 8 | 9 |
| LAS | 9 | — | — | — |
| Alkyl sulfate | 1 | — | — | — |
| TEA | 0.5 | — | — | — |
| Hostapur SAS | — | 9 | 9 | 9 |
| Genapol UD 030 | 2 | 1 | 1 | 1 |
| STPP | 14 | 12 | 12 | 12 |
| PTPP | | | | |
| Sodium disilicate | 0.5 | 0.5 | 0.5 | 0.5 |
| Praepagen HY | — | — | 2.1 | 1.5 |
| KCl | — | — | — | 2.0 |
| $K_2SO_4$ | — | — | — | — |
| Opt. brightener | 0.1 | 0.05 | 0.05 | 0.05 |
| Enzyme (Cellulase) | 0.25 | 0.25 | 0.25 | 0.25 |
| Viscosity [mPa · s] | 2750 | — | 680 | 740 |
| (Brookfield RVT, 20 rpm, 22° C.) | (spdl 3) | — | (spdl 2) | (spdl 2) |

5. Storage test with formulations II

| Conditions | 1* | 7* | 8 | 9 |
|---|---|---|---|---|
| RT, 28 days | ok | two phases | ok | ok |
| 40° C., 28 days | two phases | two phases | ok | ok |
| 5° C., 28 days | ok | two phases | ok | ok |

ok = homogeneous dispersion, no phase separation observable

6. Washing experiments with formulations II

| Conditions: | LINITEST<br>Temperature: 40° C.<br>German hardness<br>Dosing: 10 g/l | Washing time: 30 min | Water hardness: 12° |
|---|---|---|---|

| | Reflectance difference (457 nm, UV filter) [%] | | | |
|---|---|---|---|---|
| Test fabric | 1* | 7* | 8 | 9 |
| Lipstick | 14 | 12 | 20 | 20 |

This example shows that the inventive formulations containing sec-alkanesulfonate and quaternary alkylhydroxyethylammonium salt have clear advantages in the detergency on certain soilings compared with the comparative examples.

7. Preparation of the Formulations in the Laboratory

In a beaker the optical brightener is firstly made into a paste with the nonionic surfactant Genapol UD 030 using a glass rod, then if necessary alkyl sulfate and TEA are mixed in and then the Hostapur SAS 60 is likewise stirred in using a glass rod (mixture 1).

In a second beaker the required amount of demineralized water is initially introduced and firstly 9% STPP or PTPP are dissolved with stirring using a magnetic stirrer (mixture 2).

The clear mixture 2 is then stirred into mixture 1 using a glass rod until particles of the surfactant phase are no longer on the wall of the beaker.

Thereafter, the resulting mixture is further stirred using a magnetic stirrer until a homogeneous dispersion forms. The remaining amount of STPP or PTPP (3% or 5%, respectively) and then the sodium disilicate is added.

After correcting the pH to a value of pH 8.3, the required amount of Praepagen HY and potassium salt is stirred in. Finally, the cellulase is mixed in and any evaporated demineralized water is replaced.

Chemical Name of the Commercial Products Used

LAS linear $C_{12}/_{14}$-alkylbenzenesulfonate
Alkyl sulfate $C_{12}/_{14}$-alkyl sulfate
TEA Triethanolamine
Hostapour SAS sac-$C_{13-17}$-alkanesulfonate
Genapol DU 030$C_{11}$-oxo alcohol polyglycol ether, 3EO
STPP Sodium tripolyphosphate
PTPP Potassium tripolyphosphate
Praepagen HY $C_{12}/_{14}$-alkyldimethylhydroxyethylammonium chloride

What is claimed is:

1. An aqueous liquid detergent dispersion which consists of:

5% by weight to 35% by weight of anionic surfactant consisting of a sec-alkanesulfonate 10% by weight to 50% by weight of builders, 0% by weight to 10% by weight of electrolytes, 0.1% by weight to 10% by weight of quaternary alkylhydroxyethylammonium salt, selected from the group of $C_{12}$–$C_{14}$-alkyldimethylhydroxyethylammonium chloride, $C_{12}$–$C_{14}$-alkyldlmethylhydroxyethyammonium methosulfate, and mixtures thereof, and customary auxiliaries and additives selected from the group consisting of bleach activators, bleach catalysts, optical brighteners, graying inhibitors, color transfer inhibitors, solubility promoters, hydrotropes, thickeners, preservatives, fragrances and dyes, pearlizing agents, foam inhibitors, sequesterants, corrosion inhibitors, antioxidants, and mixtures thereof, where the % by weight ratio of anionic surfactant to quaternary alkylhydroxyethylammonium salt is 50:1 to 2:1.

2. The aqueous liquid detergent dispersion as claimed in claim 1, wherein the anionic surfactant consists of a sodium $C_{13}$–$C_{17}$-sec-alkanesulfonate.

3. The aqueous liquid detergent dispersion as claimed in claim 1, which consists of 5 to 25% by weight of anionic surfactant.

4. The aqueous liquid detergent dispersion as claimed in claim 1, which consists of 5 to 20% by weight of anionic surfactant.

5. The aqueous liquid detergent dispersion as claimed in claim 1, which consists of 10 to 40% by weight of builders.

6. The aqueous liquid detergent dispersion as claimed in claim 1, which consists of 10 to 30% by weight of builders.

7. The aqueous liquid detergent dispersion as claimed in claim 1, which consists of 0 to 7% by weight of electrolytes.

8. The aqueous liquid detergent dispersion as claimed in claim 1, which consists of 0 to 4% by weight of electrolytes.

9. The aqueous liquid detergent dispersion as claimed in claim 1, wherein a weight ratio of anionic surfactant to quaternary alkylhydroxyethylammonium salt is 30:1 to 2:1.

10. The aqueous liquid detergent dispersion as claimed in claim 1, wherein a weight ratio of anionic surfactant quaternary alkylhydroxyethylammonium salt is 15:1 to 2:1.

* * * * *